US006182374B1

(12) United States Patent
Yen

(10) Patent No.: US 6,182,374 B1
(45) Date of Patent: Feb. 6, 2001

(54) DRYING MACHINE

(76) Inventor: Chin-Pei Yen, No. 56, Min Sheng Street, Feng-Yuan City 42041 (TW)

( * ) Notice: Under 35 U.S.C. 154(b), the term of this patent shall be extended for 0 days.

(21) Appl. No.: 09/469,348

(22) Filed: Dec. 16, 1999

(51) Int. Cl.[7] ..... F26B 19/00

(52) U.S. Cl. ..... 34/218; 34/219; 34/225; 34/233; 99/475; 99/483

(58) Field of Search ..... 34/201, 218, 219, 34/224, 225, 232, 233; 431/1; 165/228; 62/90; 99/345, 347, 473, 474, 475, 483

(56) References Cited

U.S. PATENT DOCUMENTS 3,552,297 * 1/1971 Williams ..... 99/271
3,563,160 * 2/1971 Otsuka ..... 99/345
3,665,840 * 5/1972 Horany ..... 99/261
3,855,451 * 12/1974 Lee ..... 34/219
4,224,743 * 9/1980 Erickson et al. ..... 34/219
4,455,924 * 6/1984 Wenzel ..... 99/333
4,531,306 * 7/1985 Erickson ..... 34/225
6,102,298 * 8/2000 Bush et al. ..... 239/4

* cited by examiner

*Primary Examiner*—Steve Gravini
*Assistant Examiner*—Andrea M. Joyce

(57) ABSTRACT

A drying machine includes a rectangular housing, a plurality of tubular heater spacedly disposed on lower portion of the housing, a plurality of seasoning containers releasibly disposed above the tubular heaters, a plurality of electrical fans rotatably disposed above the seasoning containers and uniformly operated by a motor on the top of the housing and a heat exchanger on the top of the housing to form a hot air circulation to dry meat inside the housing. The housing farther includes a plurality of controllable air vents, a plurality of visual windows and a control panel which controls the operation of the elements to be worked in high quality control.

5 Claims, 6 Drawing Sheets

DRYING MACHINE

BACKGROUND OF THE INVENTION

The present invention relates to drying machines and more particularly to a drying machine adapted to dry meat and equivalents.

Previously, meat was dried under sunshine or baked by fire or drying oven. A large sized drying machine not only effectively dries large batch of meat, but also keeps it delicious.

Typical large sized drying machine as shown in FIG. 1 comprises a housing 10, heaters 11 disposing on two sides covered by conductive partitions 12, a meter 13 operating a fan 14 on the top to exhaust the moisture from inside the housing 10 through a pair of air vents 101. The housing 10 further has a plurality of air vent 102 in lateral walls and the partitions 12 has a plurality of conductive plate 121 toward the heaters 11. The meats dispose inside the housing 10. When the door 15 is closed and the machine is operated, the heating elements will provide proper heat to dry the meat, meanwhile the fan exhausts the vapor from the meat in order to enhance the drying effect.

However, this type of drying machine has the disadvantages set forth as follows:

a) can not exhaust all the vapor from housing, b) a great deal of hot air exhausts out of the housing via the air vent 101 wasting of the energy and elongate the drying time, c) the heaters together with the fan cant not form a proper air circulation inside the housing, and d) lack of the seasoning entrance to dispose the seasoning container so that each time when replenishes the seasoning must open the front door to break the drying process so as to cans effectiveness.

SUMMARY OF THE PRESENT INVENTION

The present invention has a main object to provide a drying machine which has a heat exchanger on the top to form a proper air circulation to absorb the vapor inside the housing in order to intensify the drying process.

Another object of the present invention is to provide a drying machine which has a plurality of seasoning entrances to facilitate the replenishment of the seasoning containers without breaking the drying process.

Still another object of the present invention is to provide a drying machine which has a control panel on front side to control the operations of the elements, the temperature and the humidity inside the housing so as to ensure that the dried meat to be delicious.

The present invention will become more fully understood by reference to the following detailed description thereof when read in conjunction with the attached drawings.

DETAILED DESCRIPTION OF THE PREFERRED EMBODIMENT

Figure 1:
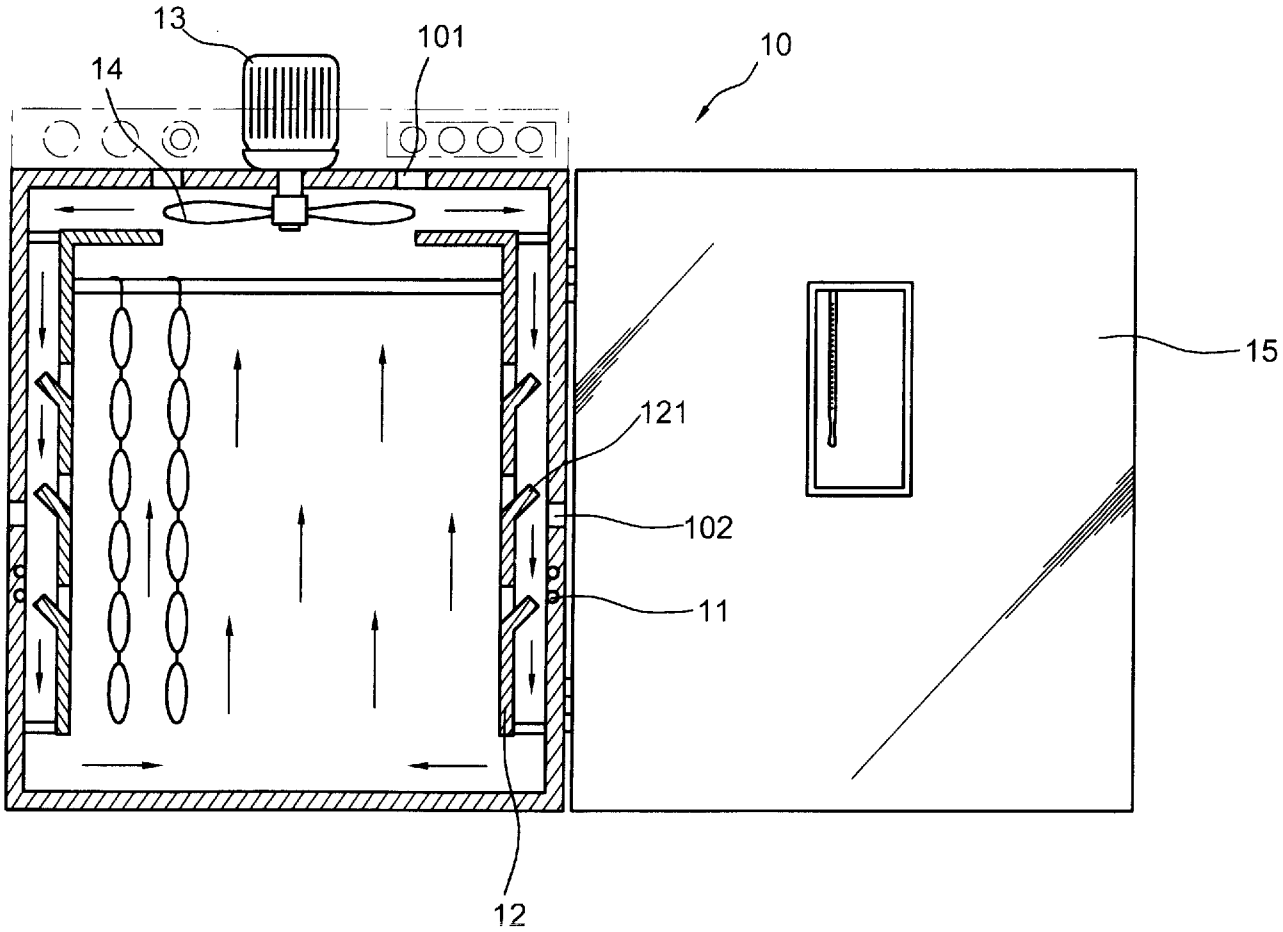
FIG. 1 Prior Art
FIG. 1 is an elevational view to show a drying machine according to a prior art.
Figure 2:
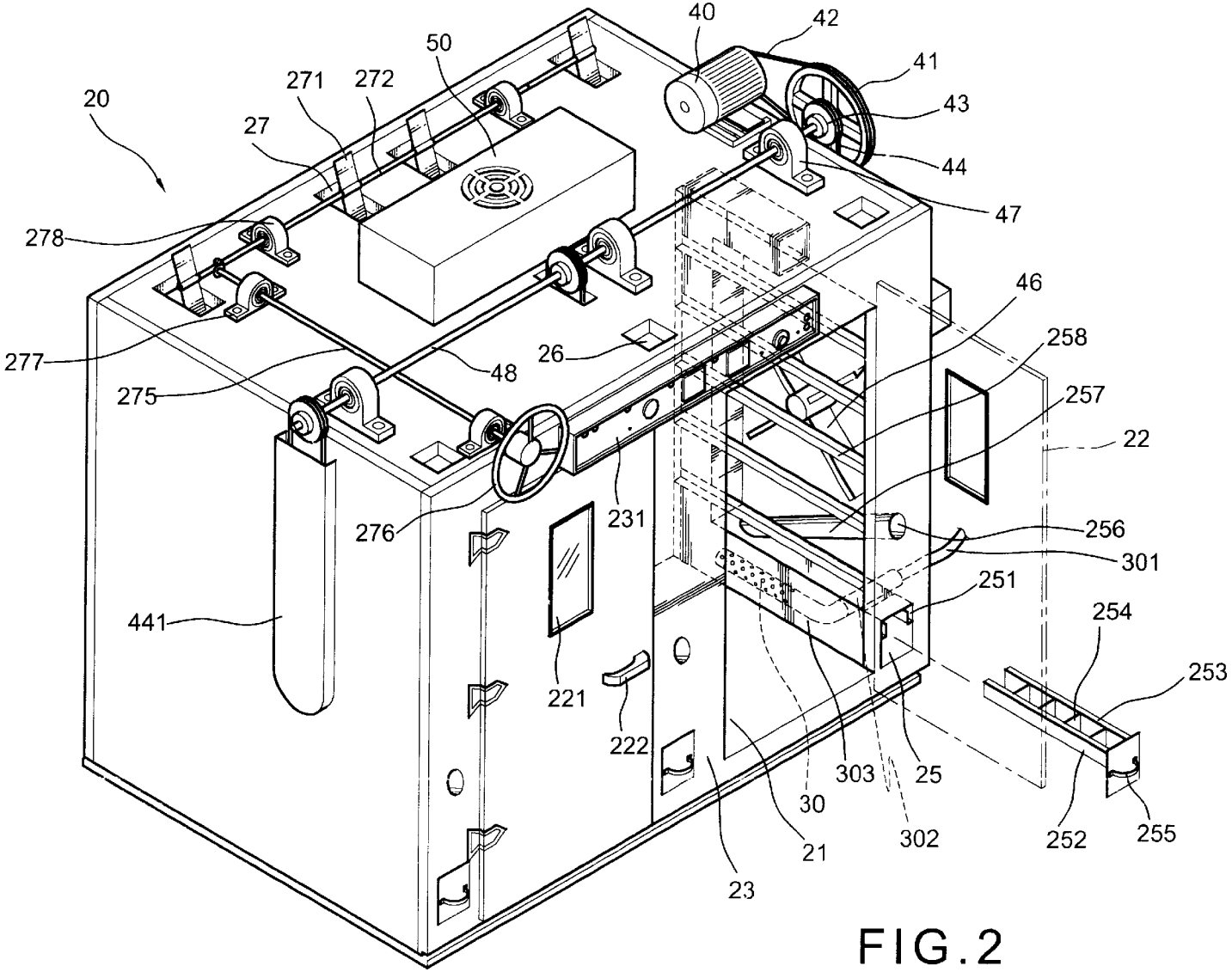
FIG. 2 is a perspective view to show a drying machine according to the preferred embodiment of the present invention.
Figure 3:
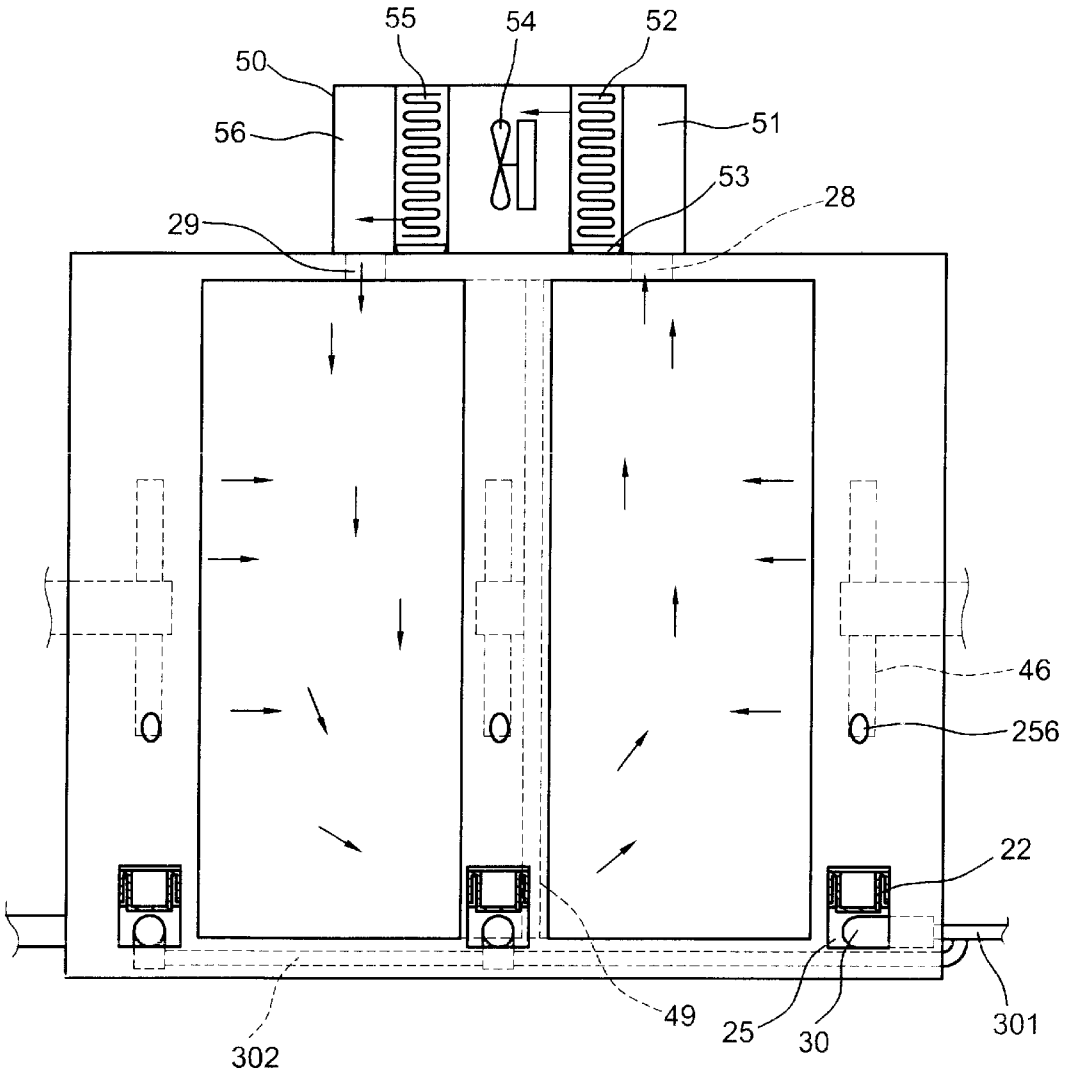
FIG. 3 is a plane view of FIG. 2.
Figure 4:
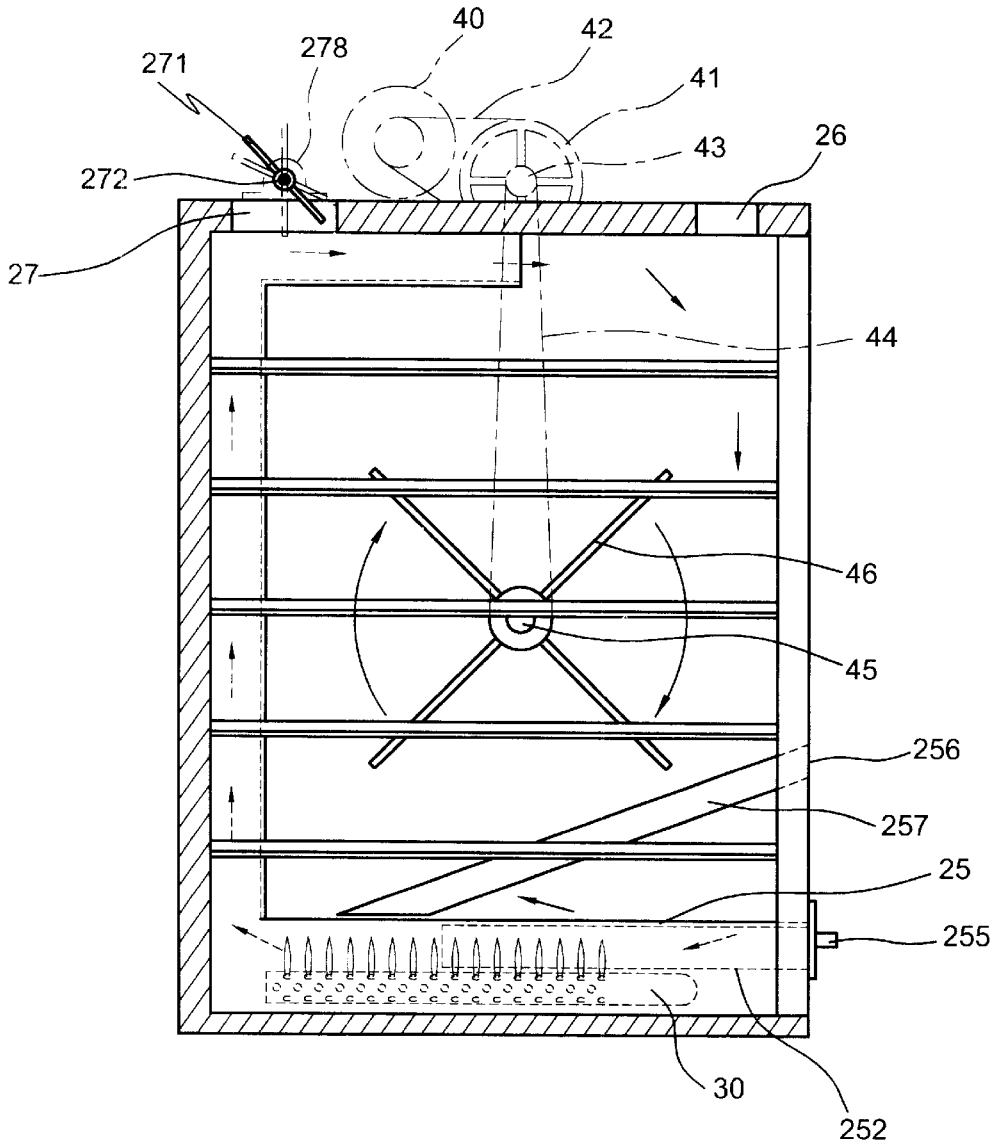
FIG. 4 is a side view of FIG. 2.
Figure 5:
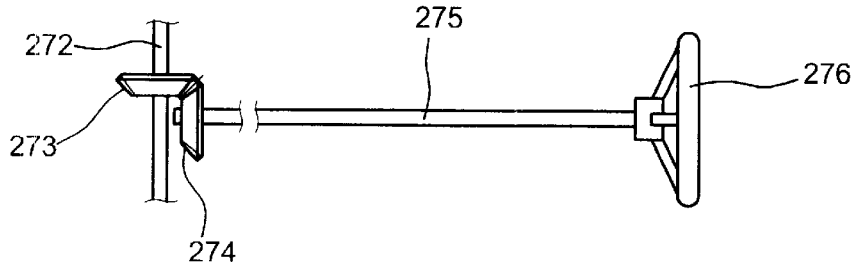
FIG. 5 is a side view to show the engagement of the bevel gears and their shafts.

With reference to FIGS. 2, 3 and 4 of the drawings, the drying machine of the present invention comprises a rectangular housing 20 having a partition 22 on front side to define a pair of openings 21 there aside, a pair of front doors 22 closing the openings 21 hinged to a lateral side of the openings 21 and each including a visual window 221 and a handle 222 on outer surface, a plurality of seasoning entraces 25 spacedly formed in front side of the housing 20 each having a pair rails 251 spacedly formed on upper portion of the lateral inner walls for releasibly receiving a seasoning container 252 which includes a pair of flanges 253 engageable with the rails 251, a plurality of compartments 254 for containing deference kind of seasonings and an arcuate handle 255 on an outer surface, a plurality of tubular heater members 30 disposed under the seasoning containers 252 each including a hose 301 connecting to an external gas source, a flame tube 302 and a sleeve 303 which is controlled by an electronic element on a panel 231 on the top of the front side of the housing 20 to provide heating effect to the housing 20, a visual tube 256 on the top of the heater members 30 through which the heater members 30 are visible, a plurality of guide bars 258 spacedly formed on lateral sides and the center of the housing 20 for slidably supporting a plurality of meat plates (not shown)inside the housing 20, a plurality of first fans 46 beside the guide bars 258 which are operated by a motor 40 on top of the housing 20 through a large wheel 41 a plurality of first belts 42, a plurality of first small wheels 43, a plurality of second belts 44 and a plurality of second small wheels 45 (as shown in FIG. 4) wherein the first small wheels 43 are connected by a first shaft 48which are rotatably engaged within a plurality of first bearing seats 47 spacedly disposed on the top of the housing 20 and the second Betts on the lateral side of the housing 20 are protected by a pair of covers 441, a plurality of first air vents 26 spacedly formed in the front top of the housing 20 and a plurality of second air vents 27 in the rear top of the housing 20, the second air vents 27 are controlled by a plurality of guide plates 271 centrally connected by a second shaft 272 which is engaged within a pair of second bearing seats 278 spacedly disposed on the rear top of the housing 20 and which has a first bevel gear 273 engaged with a second bevel gear 274 which is rotatably operated by a wheel 276 through a third shaft 275 engaged with a pair of third bearing seats 277 spaecdly disposed on a side of the top of the housing 20 (as shown in FIG. 5), and a heat exchanger 50 centrally disposed on the top of the housing 20 above an air ingress 28 and an air egress 29. The heat exchanger 50 is of a conventional type and includes an air intake. chamber 51, a tubular condenser 52 abutting the air intake chamber 51, a water trough 52 under the condenser 52, a second fan 54 at a center and a tubular heater 55 abutting an air output chamber 56 on the other side opposite to the air intake chamber 51. Both the air intake chamber 51 and the air output chamber 56 respectively communicate with the inside of the housing 20 through the air ingress 28 and the air egress 29. So that when the fan operates, the air intake chamber 51 will absorb the vapor from inside the housing. The vapor will be dried out as it passing through the tubular condenser 52 and the water in the condenser 52 drops into the trough 52 to be drained out. Then the dried out air will be lead to the output chamber 56 to blow back to the housing 20 after it was heated at the tubular heater 55. Therefore, an air circulation is formed inside the housing 20.

Figure 6:
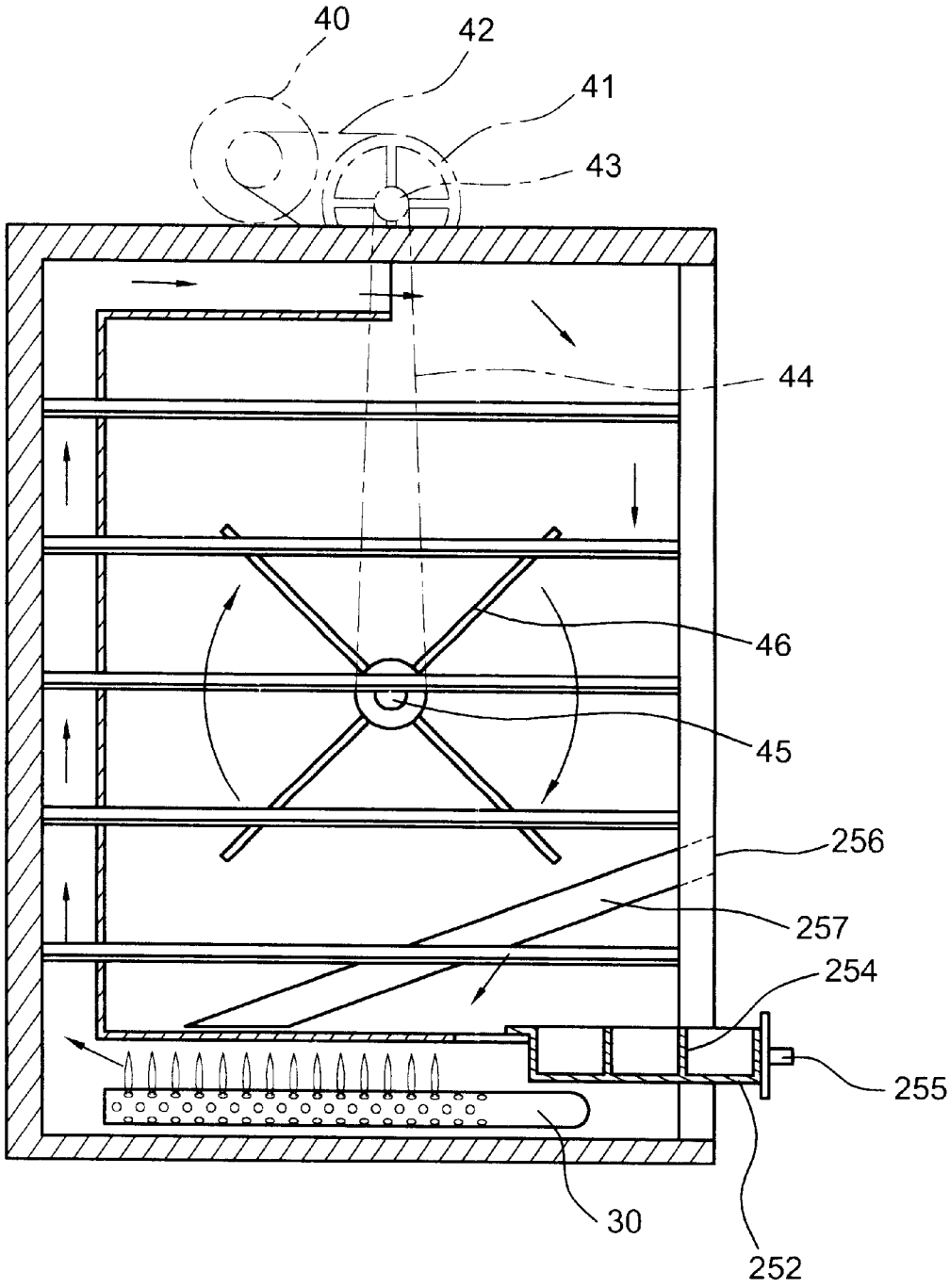
FIG. 6 is a side view of FIG. 2 to indicate the removal of the seasoning container from the housing.

Referring to FIG. 6 and FIG. 3 again, in operation, the tubular heater members 30 provides proper heating effect and the first fans 46 drive the heat into the housing 20 to dry the meat therein and the heat exchanger 50 absorbs the vapor from the meat and blows dried out hot air into the housing 20 so as to intensify the drying effect to dry the meat which contains about 30% to 40% water.

The seasonings in the seasoning containers 252 are evaporated by the heater member 30 to permeate averagely into the meat and the seasoning containers 30 are readily to remove from the seasoning entrances 25 to replenish the seasonings without opening the front door 22 so as to prevent the heat from escaping from the housing 20.

The operations of the elements are controllable by the control panel 231 through its electronic system and are visible through the visual widows 221 and the visual tubes 256. So that the working pieces are processed under high quality control.

Figure 7:
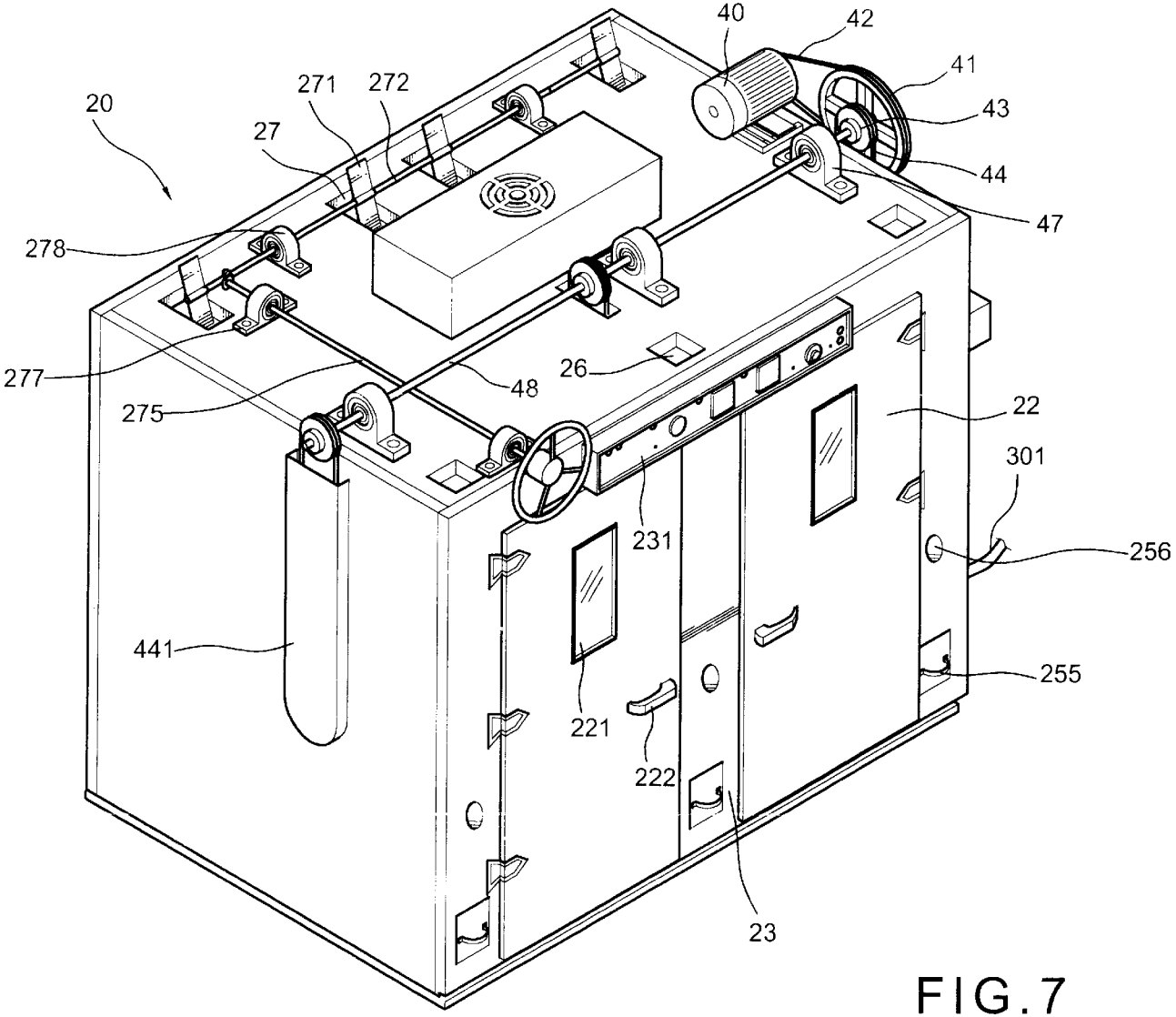
FIG. 7 is a perspective view showing the outlook of the preferred embodiment of the present invention.

The temperature inside the housing 20 is further controlled by operating the wheel 276 to rotate the guide plates 271 to turn a certain angle or to close and open the second air vents 27. FIG. 7 shows an outlook of the drying machine according to the present invention.

Based the above description, the drying machine of the present invention can be operated under high quality control more effectiveness and economical than the conventional drying machines.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A drying machine comprising:

a rectangular housing having an opening on front portion, a partition at center of the opening to define the housing into a pair of compartments, a pair of doors to close the compartments and each including a visual window and a handle on an outer surface, a control panel on front top of the housing, a plurality of seasoning entrances spacedly formed in lower portion of the housing for releasably receiving a plurality of seasoning containers and each having a pair of rails spacedly formed on upper portion of lateral inner wall of the entrances, a plurality of guide bars spacedly formed above each of the seasoning entrances for supporting a plurality of meat plates, a plurality of first air vents spacedly formed in front top of the housing and a plurality of second air vents spacedly formed in rear top of the housing;

a plurality of tubular heater members spacedly disposed under each of the seasoning entrances and each including a hose connecting to an external gas source, a flame tube and a sleeve;

a plurality of visual tubes spacedly and slopedly disposed above each of the seasoning entrances;

a plurality of electrical fans rotatably disposed above each of the visual tubes and operated by a motor, a large wheel and a first belt on the top of the housing and through a plurality of small wheels and plurality of second belts, said small wheels on the top being spacedly connected by a first shaft which is spacedly engaged within a plurality of first bearing seats on the top of the housing, and a pair of cover means covering the second belts outside lateral walls of the housing;

a heat exchanger on the top of the housing above an air ingress and an air egress communicating with the housing;

whereby said tubular heater member and said heat exchanger form a proper hot air circulation inside said housing to effectively dry meat under high quality control.

2. The drying machine as recited in claim 1 wherein said seasoning container includes a pair of flanges slidably engageable with the rails of said seasoning entrance, a plurality of compartments and a handle on an outer surface.

3. The drying machine as recited in claim 1 further includes a plurality of guide plates for selectively closing and opening the second air vent in the top of the housing, said guide plates being centrally and spacedly connected by a second shaft which is engaged within a pair of second bearing seats spacedly disposed on the top of the housing and having a first bevel gear adjacent an end thereof.

4. The drying machine as recited in claim 1 further includes a second bevel gear engaged with a first bevel gear, said second bevel gear being connected to one end of a third shaft which has other end connecting to a second large wheel and engaged within a pair of third bearing seats spacedly disposed on the top of the housing and positioned opposite to said motor.

5. The drying machine as recited in claim 1 wherein said heat exchanger absorbs the vapor from the meat and provides dried hot air into the housing.

* * * * *